US005656874A

United States Patent [19]

Kato et al.

[11] Patent Number: 5,656,874

[45] Date of Patent: Aug. 12, 1997

[54] HIGH-FREQUENCY COMPONENT AND HIGH-FREQUENCY CIRCUIT

[75] Inventors: Mitsuhide Kato; Teruhisa Tsuru; Koji Furutani, all of Nagaokakyo, Japan

[73] Assignee: Murata Manufacturing Co., Ltd., Japan

[21] Appl. No.: 736,272

[22] Filed: Oct. 24, 1996

Related U.S. Application Data

[63] Continuation of Ser. No. 410,051, Mar. 24, 1995, abandoned.

[30] Foreign Application Priority Data

Mar. 24, 1994 [JP] Japan ..... 6-054010

[51] Int. Cl.[6] ..... H01P 3/08

[52] U.S. Cl. ..... 307/111; 333/246; 333/262

[58] Field of Search ..... 307/111, 112, 307/103; 333/103, 104, 262, 164, 238, 246, 81 A

[56] References Cited

U.S. PATENT DOCUMENTS

| | | | |
|---|---|---|---|
| 5,193,218 | 3/1993 | Shimo | 333/104 |
| 5,208,564 | 5/1993 | Burns et al. | 333/164 |
| 5,311,406 | 5/1994 | Snodgràss et al. | 333/238 |
| 5,369,379 | 11/1994 | Fujiki | 333/246 |
| 5,418,505 | 5/1995 | Agarwal et al. | 333/246 |
| 5,479,141 | 12/1995 | Ishizaki et al. | 333/246 |

*Primary Examiner*—Richard T. Elms

*Attorney, Agent, or Firm*—Ostrolenk, Faber, Gerb & Soffen, LLP

[57] ABSTRACT

A ground electrode is formed on the back surface of a dielectric substrate, while a high-frequency element consisting of a diode or a transistor and signal lines conducting with the high-frequency element are formed on the front surface thereof. Striplines are formed to extend from intermediate portions of the signal lines, while capacitor electrodes having constant surface areas are formed on nodes between the signal lines and the striplines respectively.

14 Claims, 3 Drawing Sheets

HIGH-FREQUENCY COMPONENT AND HIGH-FREQUENCY CIRCUIT

This is a Continuation of application Ser. No. 08/410,051, filed on Mar. 24, 1995 now abandoned.

BACKGROUND OF THE INVENTION

1. Field of the Invention

The present invention relates to a structure of a high-frequency component having a high-frequency element to which a dc bias is applied through a transmission line.

2. Description of the Background Art

As shown in FIG. 6, a conventional high-frequency component such as an antenna switch, for example, comprises a high-frequency element 2 such as a diode or a transistor which is provided on a signal line 1, and first and second transmission lines 3 and 4 which are connected to input and output sides of the high-frequency element 2 respectively. The first and second transmission lines 3 and 4 are formed by striplines or coplanar lines, for example, so that single ends thereof are grounded. Further, capacitors C1 and C2 are provided on the input and output ends of the high-frequency element 2 respectively, while a capacitor C3 is provided between the first transmission line 3 and the ground. In addition, a dc voltage Vc is applied to a node between the first transmission line 3 and the capacitor C3. Therefore, the current at the dc bias Vc is carried to the ground through the first transmission line 3, the high-frequency element 2 and the second transmission line 4. The capacitors C1 to C3 serve as direct current inhibiting capacitors for inhibiting passage of the direct current so that the current of the dc bias Vc flows only in the circuit passing through the high-frequency element 2 and the first and second transmission lines 3 and 4.

The first and second transmission lines 3 and 4 are set at line lengths of $\lambda/4$ with respect to the wavelength $\lambda$ of an actuating signal for the high-frequency element 2. In operation of the high-frequency element 2, therefore, the impedances of the first and second transmission lines 3 and 4 are substantially infinitely increased, thereby preventing the signal flowing through the signal line 1 from leaking toward the ground through the transmission lines 3 and 4.

When the high-frequency element 2 has a low operating frequency, i.e., when the actuating signal has a long wavelength, however, the line lengths of the first and second transmission lines 3 and 4 must be increased in response to the wavelength. Thus, the size of the high-frequency element 2 is disadvantageously increased. When the operating frequency of the high-frequency element 2 is varied, further, the line lengths of the transmission lines 3 and 4 must also be varied in response thereto. Thus, it is difficult to cope with various operating frequencies of the high-frequency element 2.

SUMMARY OF THE INVENTION

An object of the present invention is to miniaturize a high-frequency component employing transmission lines.

Another object of the present invention is to provide a high-frequency component which can readily cope with variation of the operating frequency of a high-frequency element.

A high-frequency circuit according to the present invention comprises input and output ends for a high-frequency signal, a high-frequency element, a first signal line connecting the input end with the high-frequency element, a second signal line connecting the high-frequency element with the output line, a first transmission line which is provided between a first node formed on the first signal line and a ground electrode, a second transmission line which is provided between a second node formed on the second signal line and the ground electrode, a first capacitor which is provided between the first node and the ground electrode, and a second capacitor which is provided between the second node and the ground electrode.

A high-frequency component according to the present invention comprises a dielectric substrate having first and second major surfaces which are opposite to each other, input and output terminals for a high-frequency signal, a high-frequency element which is formed on the first major surface of the dielectric substrate, a first signal line conductor connecting the input end with the high-frequency element, a second signal line conductor connecting the high-frequency element with the output terminal, a first transmission line which is provided between a first node on the first signal line conductor and a ground electrode, a second transmission line which is provided between a second node on the second signal line conductor and the ground electrode, a first capacitor electrode which is provided between the first node and the ground electrode, and a second capacitor electrode which is provided between the second node and the ground electrode, so that a first capacitor is formed by the first capacitor electrode and the ground electrode while a second capacitor is formed by the second capacitor electrode and the ground electrode. The ground electrode is formed on a position which is different from those of the first and second signal line conductors, the first and second transmission lines and the first and second capacitor electrodes along the thickness direction of the dielectric substrate, oppositely to the first and second capacitor electrodes. The high-frequency component further comprises first and second connecting conductors connecting the ground electrode with the first and second transmission lines respectively.

According to the aforementioned structure, the first and second capacitors are provided between the first and second nodes of the first and second signal lines and the ground electrode respectively, whereby the resonance frequencies of the first and second transmission lines are reduced. When the operating frequency of the high-frequency element is reduced, therefore, it is possible to reduce the resonance frequencies of the transmission lines without increasing the line lengths thereof. Thus, it is possible to cope with reduction of the operating frequency of the high-frequency element without increasing the size of the high-frequency component. Similarly, it is possible to vary the resonance frequencies of the first and second transmission lines by adjusting electrode areas of the first and second capacitors. Thus, it is possible to cope with variation of the operating frequency of the high-frequency element without changing the line lengths of the transmission lines.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Preferred embodiments of the present invention are now described with reference to the drawings, to clarify the present invention.

Figure 1:
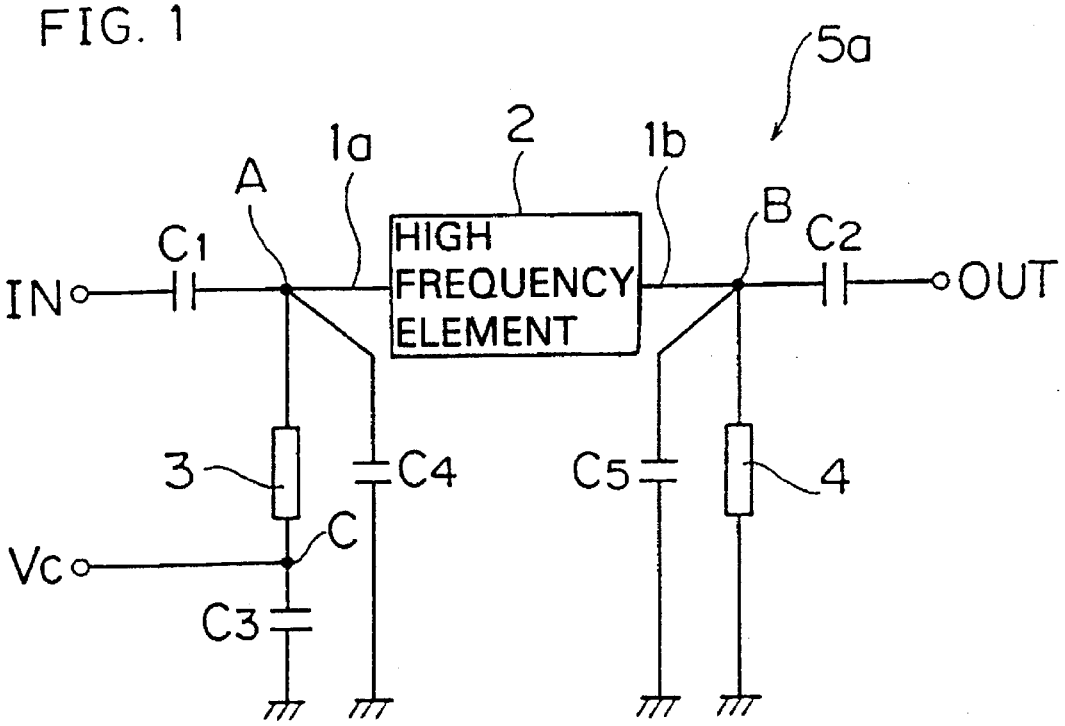
FIG. 1 is a circuit diagram of a high-frequency component according to the present invention.

Referring to a circuit diagram shown in FIG. 1, a high-frequency component 5*a* according to the present invention comprises a high-frequency element 2 formed by a diode or a transistor, which is connected between signal lines 1*a* and 1*b* connecting input and output terminals IN and OUT with each other. An end of the first transmission line 3 is connected to a node A of the signal line 1*a*, while another end thereof is connected to the ground through a capacitor C3. On the other hand, an end of the second transmission line 4 is connected to a node B of the signal line 1*b*, while another end thereof is connected to the ground.

A capacitor C4 is provided between the node A of the signal line 1*a* and the ground, while a capacitor C5 is provided between the node B of the signal line 1*b* and the ground.

In addition, a voltage source for a dc bias voltage Vc is connected to a node C between the first transmission line 3 and the capacitor C3.

In the aforementioned structure, it is possible to reduce the resonance frequencies of the first and second transmission lines 3 and 4 by providing the capacitors C4 and C5 in parallel with the first and second transmission lines 3 and 4 respectively. When the operating frequency of an actuating signal which is supplied to the high-frequency element 2 is reduced, therefore, it is possible to reduce the resonance frequencies of the first and second transmission lines 3 and 4 in response thereto through the capacitors C4 and C5.

Structures of high-frequency components embodying the circuit structure shown in FIG. 1 are now described.

First Embodiment

Figure 2:
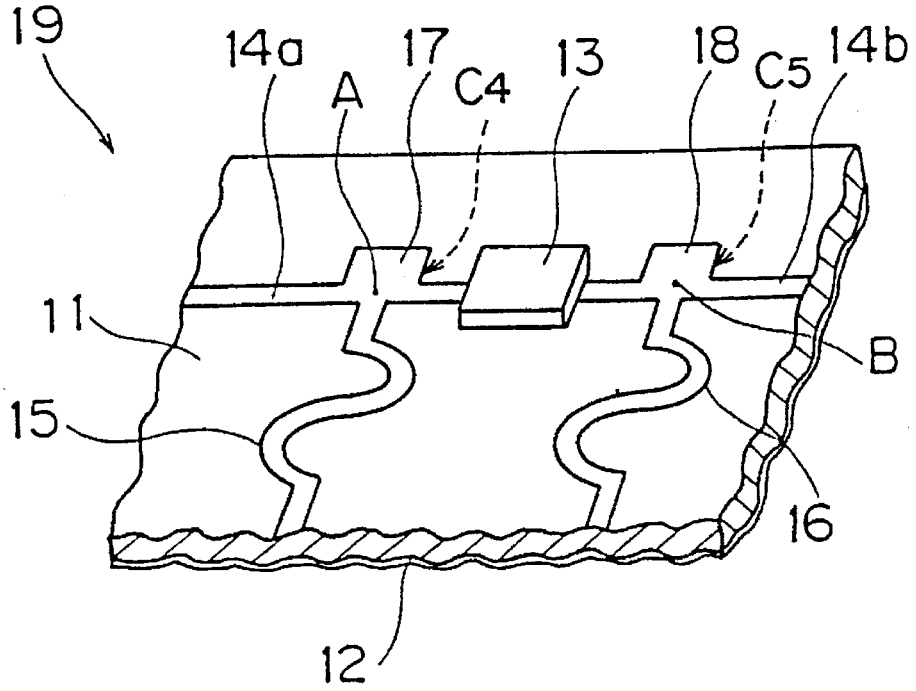
FIG. 2 is a perspective view showing a high-frequency component according to a first embodiment of the present invention.

Referring to FIG. 2, a high-frequency component 19 according to a first embodiment of the present invention comprises a dielectric substrate 11, which is provided on its surface with a high-frequency element 13 formed by a diode or a transistor, and signal lines 14*a* and 14*b* conducting with the high-frequency element 13.

Further, meandering striplines 15 and 16 are formed on the surface of the dielectric substrate 11, as transmission lines. An end of the meandering stripline 15 is connected to the signal line 14*a* at a node A, while another end thereof is connected to a ground electrode 12 which is formed on the back surface of the dielectric substrate 11 through a capacitor C3 (not shown). Further, a conductor (not shown) is connected between the stripline 15 and the capacitor C3 (not shown) for applying adc bias. An end of the second stripline 16 is connected to the signal line 14*b* at a node B, while another end thereof is connected to the ground electrode 12 which is formed on the back surface of the dielectric substrate 11. The line lengths of the first and second striplines 15 and 16 are set at ¼ (λ/4) of a wave-length k corresponding to the operating frequency of the high-frequency element 13.

A capacitor electrode 17 having a constant surface area is formed on the node A of the signal line 14*a* oppositely to the first stripline 15, while another capacitor electrode 18 having a constant surface area is formed on the node B of the signal line 14*b* oppositely to the second stripline 16. A capacitor C4 is formed by the capacitor electrode 17, the ground electrode 12 and the dielectric substrate 11 intervening therebetween, while a capacitor C5 is similarly formed by the capacitor electrode 18, the ground electrode 12 and the dielectric substrate 11 intervening therebetween. Capacitances of the capacitors C4 and C5 are defined by the surface areas of the capacitor electrodes 17 and 18 respectively.

In the high-frequency component 19 having the aforementioned structure, the resonance frequencies of the striplines 15 and 16 are reduced by the capacitors C4 and C5. When the resonance frequencies are rendered constant, on the other hand, it is possible to reduce the line lengths of the striplines 15 and 16 as compared with the prior art having no capacitors C4 and C5. Namely, it is possible to vary the capacitances of the capacitors C4 and C5 thereby regulating the resonance frequencies of the striplines 15 and 16 in the high-frequency component 19 according to this embodiment, by adjusting the capacitances of the capacitors C4 and C5, i.e., by trimming the capacitor electrodes 17 and 18 and the ground electrode 12.

Second Embodiment

Figure 3:
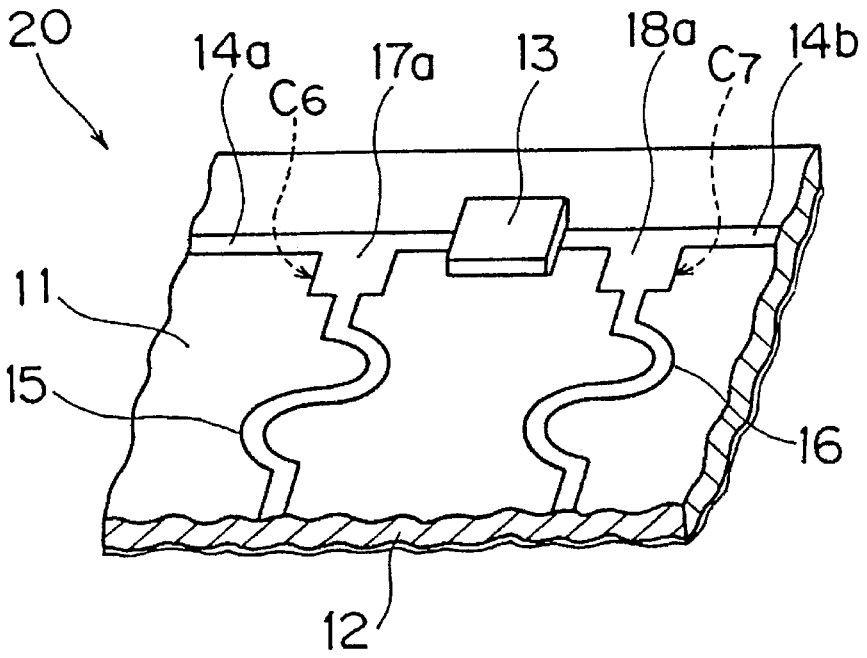
FIG. 3 is a perspective view showing a high-frequency component according to a second embodiment of the present invention.

As shown in FIG. 3, a high-frequency component 20 according to a second embodiment of the present invention is different from that of the first embodiment in positions of capacitor electrodes 17*a* and 18*a*. According to this embodiment, the capacitor electrodes 17*a* and 18*a* are formed between signal lines 14*a* and 14*b* and striplines 15 and 16 respectively. Capacitors C6 and C7 are formed by the capacitor electrodes 17*a* and 18*a*, a ground electrode 12 and a dielectric substrate 11 respectively. Also in such a structure, it is possible to attain an effect which is similar to that of the high-frequency component 19 according to the first embodiment.

Figure 4A:
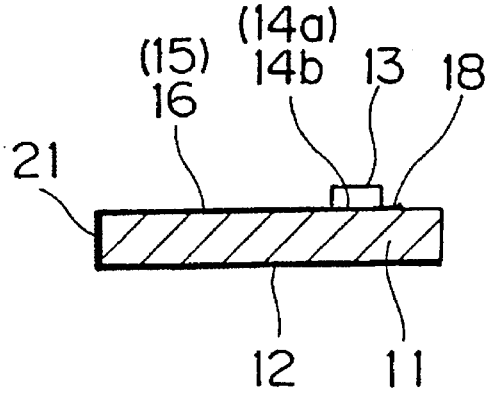
FIG. 4A is a sectional view showing a side electrode of the high-frequency component according to each embodiment of the present invention.
Figure 4B:
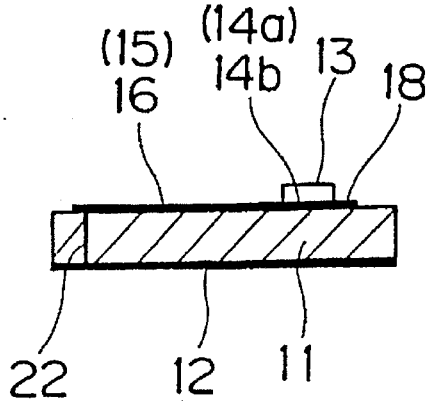
FIG. 4B is a sectional view showing a connecting electrode structure employing a viahole in the high-frequency component according to each embodiment of the present invention.

FIGS. 4A and 4B show exemplary structures of connecting conductors for each of the aforementioned high-frequency components 19 and 20 according to the first and second embodiments. As shown in the circuit diagram of FIG. 1, it is necessary to connect single ends of the striplines 15 and 16 (3 and 4) to the ground electrode 12 which is provided on the back surface of the dielectric substrate 11. Therefore, the stripline 16 (15) which is formed on the surface of the dielectric substrate 11 is connected with the ground electrode 12 formed on the back surface, through a connecting conductor. In the example shown in FIG. 4A, the connecting conductor is formed by a side electrode 21 which is provided on a side surface of the dielectric substrate 11.

In the example shown in FIG. 4B, on the other hand, the stripline 16 (15) is connected with the ground electrode 12 through a viahole 22 which is formed in the dielectric substrate 11.

In each of the aforementioned first and second embodiments, the capacitors C4 to C7 which are formed between the nodes A and B of the signal lines 14*a* and 14*b* and the striplines 14 and 15 and the ground electrode 12 may alternatively be provided by mounting chip capacitors on the surface of the dielectric substrate 11. Namely, it is also possible to form electrode patterns conducting with the ground electrode 12 on the surface of the dielectric substrate 11, so that chip capacitors are connected between the electrode patterns and the nodes A and B.

Third Embodiment

Figure 5:
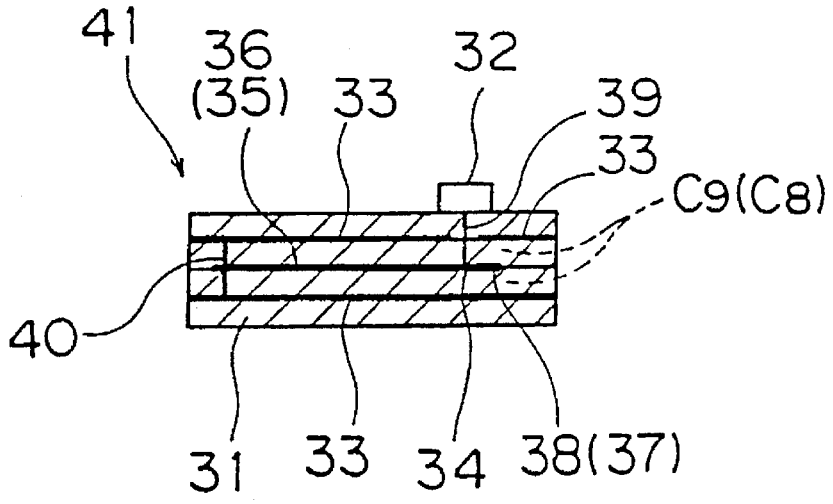
FIG. 5 is a sectional view showing a high-frequency component according to a third embodiment of the present invention.
Figure 6:
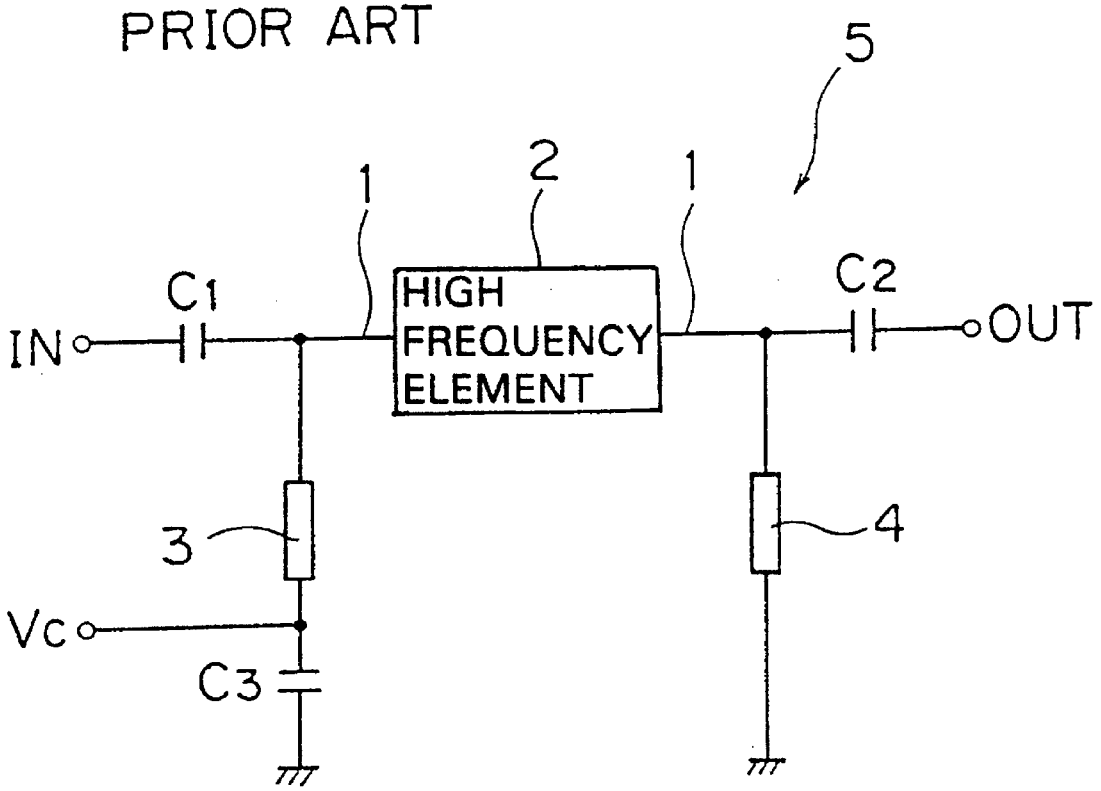
FIG. 6 PRIOR ART
FIG. 6 is a circuit diagram of a conventional high-frequency component.

As shown in FIG. 5, a high-frequency component 41 according to a third embodiment of the present invention is formed by a multilayer dielectric substrate 31 which is obtained by stacking a number of dielectric layers with each other. Referring to FIG. 5, for example, the multilayer dielectric substrate 31 has four dielectric layers which are stacked with each other. A high-frequency element 32 is mounted on the surface of the multilayer dielectric substrate 31. Further, a signal line 34, striplines 35 and 36 and capacitor electrodes 37 and 38 are formed between the second and third dielectric layers from the bottom layer. Electrode patterns for the signal line 34, the striplines 35 and 36 and the capacitor electrodes 37 and 38 can be formed similarly to those of the first and second embodiments.

Further, ground electrodes 33 are formed between the first and second dielectric layers as well as between the third and fourth dielectric layers of the dielectric substrate 31 respectively. The stripline 35 is connected to the ground electrodes 33 through a capacitor (not shown) which is formed in the multilayer dielectric substrate 31, while the stripline 36 is connected to the ground electrodes 33 through a viahole 40. Further, the signal line 34 is connected with the high-frequency element 32 through a viahole 39. In addition, capacitors C8 and C9 are formed between the capacitor electrodes 37 and 38 and the ground electrodes 33 respectively.

As a modification of this embodiment, it is also possible to form the ground electrodes 33 on the front and back surfaces of the multilayer dielectric substrate 31 respectively.

The characteristics of the high-frequency component according to the present invention are now described in more concrete terms. When a stripline having a line length of 9 mm and a resonance frequency of 3.3 GHz is formed on a dielectric substrate having a relative dielectric constant $\epsilon$ of 6 and a capacitor of 1 pF is formed in parallel therewith, the resonance frequency of the stripline is reduced to 2.1 GHz. When only a stripline having a resonance frequency of 2.1 GHz is formed on a dielectric substrate having a dielectric constant $\epsilon$ of 6 with no formation of the capacitor according to the present invention, on the other hand, the stripline requires a line length of 14.5 mm. In the high-frequency component according to the present invention, however, the stripline requires the line length of only 9 mm. According to the present invention, therefore, it is possible to reduce the lengths of the stripline as compared with the conventional high-frequency component.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A high-frequency circuit, comprising:

input and output ends for a high-frequency signal;

a high-frequency element;

a first signal line connecting said input end with said high-frequency element;

a second signal line connecting said high-frequency element with said output end;

a first transmission line provided between a first node on said first signal line and a ground electrode;

a second transmission line provided between a second node on said second signal line and said ground electrode;

a first capacitor provided between said first node and said ground electrode; and a second capacitor provided between said second node and said ground electrode;

said first transmission line and first capacitor arranged to generate resonance at one quarter wavelength of said high-frequency signal;

said second transmission line and second capacitor arranged to generate resonance at one quarter wavelength of said high-freguency signal;

the first and second transmission lines functioning so that the high-frequency element is biased by said first and second transmission lines, the first and second capacitors connected to the first and second transmission lines, respectively, whereby a physical length of the first and second transmission lines is shortened as compared to a physical length of the first and second transmission lines necessary without said first and second capacitors.

2. A high-frequency component, comprising:

a dielectric substrate having first and second major surfaces opposite to each other;

input and output terminals for a high-frequency signal;

a high-frequency element on said first major surface of said dielectric substrate;

a first signal line conductor connecting said input terminal with said high-frequency element;

a second signal line conductor connecting said high-frequency element with said output terminal;

a ground electrode;

a first transmission line provided between a first node on said first signal line conductor and said ground electrode;

a second transmission line provided between a second node on said second signal line conductor and said ground electrode;

a first capacitor electrode provided between said first node and said ground electrode; and a second capacitor electrode provided between said second node and said ground electrode, a first capacitor comprising said first capacitor electrode, said ground electrode and said dielectric substrate, a second capacitor comprising said second capacitor electrode, said ground electrode and said dielectric substrate, said ground electrode formed at a position different from positions of said first and second signal line conductors, said first and second transmission lines and said first and second capacitor electrodes along a thickness direction of said dielectric substrate and oppositely to said first and second capacitor electrodes and said first and second transmission lines, and further comprising first and second connecting conductors connecting said ground electrode with said first and second transmission lines respectively;

said first transmission line and first capacitor arranged to generate resonance at one quarter wavelength of said high-frequency signal;

said second transmission line and second capacitor arranged to generate resonance at one quarter wavelength of said high-frequency signal;

the first and second transmission lines functioning so that the high-frequency element is biased by said first and second transmission lines, the first and second capacitors connected to the first and second transmission lines, respectively, whereby a physical length of the first and second transmission lines is shortened as compared to a physical length of the first and second transmission lines necessary without said first and second capacitors.

3. The high-frequency component in accordance with claim 2, wherein said first and second signal line conductors, said first and second transmission lines and said first and second capacitor electrodes are formed on said first major surface of said dielectric substrate, said ground electrode formed on said second major surface of said dielectric substrate.

4. The high-frequency component in accordance with claim 3, wherein said first capacitor electrode is connected to said first signal line conductor at said first node of said first signal line conductor, said first transmission line is connected to said first signal line conductor at said first node of said first signal line conductor, said second capacitor electrode is connected to said second signal line conductor at said second node of said second signal line conductor, and said second transmission line is connected to said second signal line conductor at said second node of said second signal line conductor.

5. The high-frequency component in accordance with claim 3, wherein said first capacitor electrode is connected to said first signal line conductor at said first node of said first signal line conductor, said first transmission line extends from said first capacitor electrode, said second capacitor electrode is connected to said second signal line conductor at said second node of said second signal line conductor, and said second transmission line extends from said second capacitor electrode.

6. The high-frequency component in accordance with claim 2 said first and second connecting conductors are formed in through holes in said dielectric substrate.

7. The high-frequency component in accordance with claim 2 wherein said first and second connecting conductors are formed on side surfaces of said dielectric substrate.

8. The high-frequency component in accordance with claim 2, wherein said first and second signal line conductors, said first and second transmission lines, said first and second capacitor electrodes and said ground electrode are formed in the interior of said dielectric substrate.

9. The high-frequency component in accordance with claim 3, wherein said first and second connecting conductors are formed in through holes in said dielectric substrate.

10. The high-frequency component in accordance with claim 4, wherein said first and second connecting conductors are formed in through holes in said dielectric substrate.

11. The high-frequency component in accordance with claim 5, wherein said first and second connecting conductors are formed in through holes in said dielectric substrate.

12. The high-frequency component in accordance with claim 3, wherein said first and second connecting conductors are formed on side surfaces of said dielectric substrate.

13. The high-frequency component in accordance with claim 4, wherein said first and second connecting conductors are formed on side surfaces of said dielectric substrate.

14. The high-frequency component in accordance with claim 5, wherein said first and second connecting conductors are formed on side surfaces of said dielectric substrate.

* * * * *